United States Patent [19]

Hall

[11] 4,063,678

[45] * Dec. 20, 1977

[54] BOX CONSTRUCTION

[75] Inventor: Richard A. Hall, Pleasanton, Calif.

[73] Assignee: Willamette Industries, Inc., San Leandro, Calif.

[ * ] Notice: The portion of the term of this patent subsequent to Apr. 13, 1993, has been disclaimed.

[21] Appl. No.: 723,595

[22] Filed: Sept. 15, 1976

[51] Int. Cl.[2] ..... B65D 5/10

[52] U.S. Cl. ..... 229/39 R; 206/626

[58] Field of Search ..... 229/39 R, 51 TS, 51 TC; 206/807

[56] References Cited

U.S. PATENT DOCUMENTS

| | | | |
|---|---|---|---|
| 291,805 | 1/1884 | Tatum | 229/39 R |
| 2,287,520 | 6/1942 | Freshwaters | 229/51 TC |
| 2,363,861 | 11/1944 | Goodyear | 229/51 TC X |
| 3,576,290 | 4/1971 | Marchisen | 229/39 R |
| 3,949,931 | 4/1976 | Hall | 206/807 |

*Primary Examiner*—Herbert F. Ross

[57] ABSTRACT

A box construction is provided which enables a box to be assembled from a pre-cut form in which when assembled includes means for locking the top sections together in such fashion that, if an attempt is made to open the box in an unauthorized manner, the attempt at pilferage will be readily apparent.

4 Claims, 4 Drawing Figures

BOX CONSTRUCTION

SUMMARY OF THE INVENTION

It is in general the broad object of the invention to provide a simple box construction enabling a box blank to be readily assembled into a completed structure which structure includes a top closure means such that any attempt at pilfering will be readily ascertained.

DESCRIPTION OF THE PREFERRED EMBODIMENT

Figure 4:
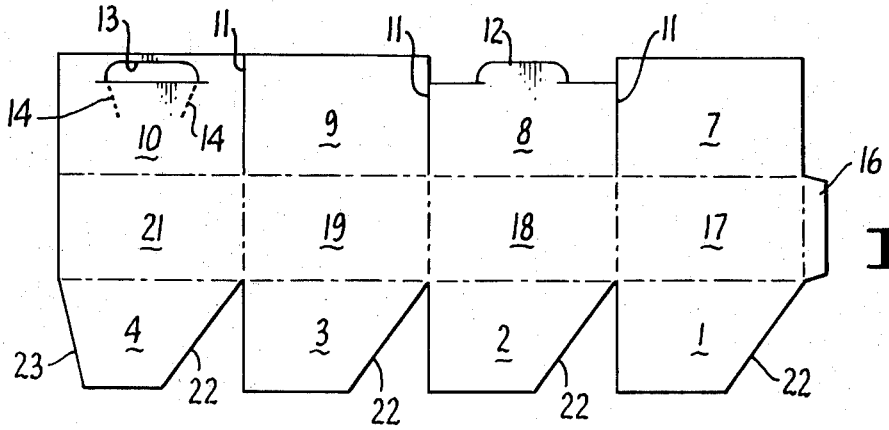
FIG. 4 is a plan view of the box blank in pre-cut form and prior to assembly.

Referring particularly to FIG. 4 in the drawing, each box is formed by cutting a blank in the outline shown from a single flat sheet of corrugated board. The blank has a series of top panels, designated as 7, 8, 9 and 10, each separated from the next adjacent panel by cuts 11. Panel 8 is slightly recessed as compared to panels 7 and 9 to provide a tongue 12. Panel 10 has a cutout portion 13 of a size to receive tongue 12 in snug engagement. Adjacent the lower end of cutout portion 13 score lines 14 are provided to facilitate opening of the container by an authorized person.

A projecting portion 16 is provided at one end of a side panel 17, the latter being one of a series of side panels including panel 17 and panels 18, 19 and 21. Affixed to each panel 17, 18, 19 and 21 are bottom panels, designated by numerals 1, 2, 3 and 4, each of bottom panels 1, 2 and 3 being of a trapezoidal shape including an angular positioned side 22 while panel 4 has an angular side 23. The several panels are each of the same length so that when assembled the box is a cube.

To assemble the box, the projecting portion 16 is engaged with the end panel 21 and is secured in place with a suitable adhesive. The blank is then closed upon itself and panels 1, 2, 3 and 4 are then successively moved into position so that panel 2 overlaps panel 1, panel 3 overlaps panel 2 and the angular face 23 on panel 4 underlies panel 1.

Figure 1:
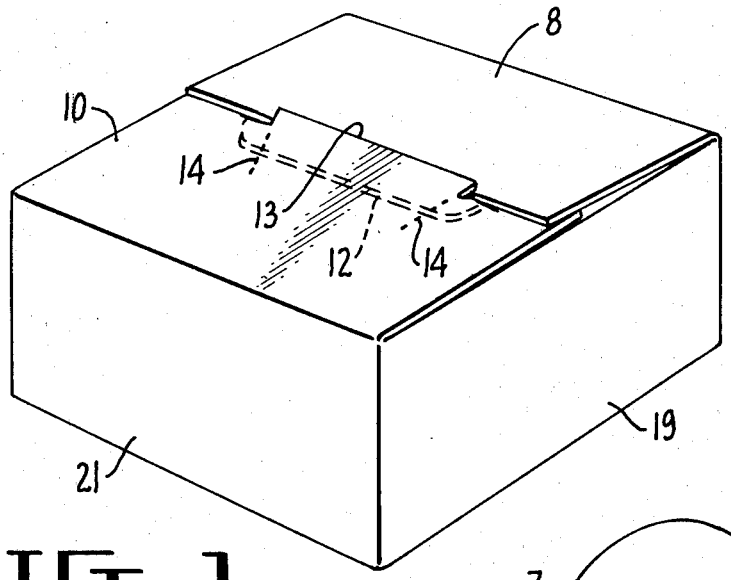
FIG. 1 is a perspective view of a box in assembled position.
Figure 2:
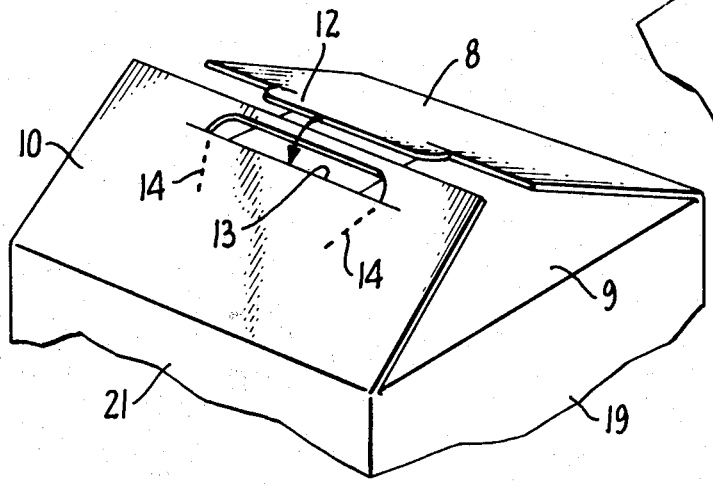
FIGS. 2 and 3 are perspective views illustrating the manner of assembling the locking means on the box top.
Figure 3:
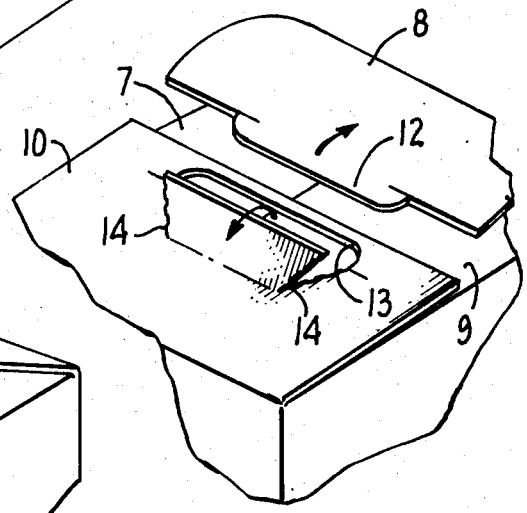

In use, the box is assembled and is then filled with a commodity as desired. The top of the box is then closed by inserting the tongue 12 to engage the opening 13 and fit within that opening and extend beyond its edges as appears in FIG. 1. When it is desired to gain authorized access to the contents of the container, a lifting force applied upon that portion of panel 10 immediately adjacent the opening 13 will displace that portion of panel 10, between the serrations 14 and will permit the tongue 12 to be withdrawn.

I claim:

1. A box formed from an integral blank, comprising:

a first pair of rectangular side panels;

a second pair of rectangular side panels, said side panels each having end edges and side edges with said first side panels being connected to each other along a pair of adjacent end edges and each of said second panels being connected along one end edge thereof to the other end edge of each of said first panels;

a projecting portion connected to one of said second side panels along the other end edge thereof and adhesively attached to said other side panel of said second pair of side panels;

a plurality of rectangular top panels each having side edges and end edges and each connected to a side panel along a side edge;

an elongate tongue connected along another side edge of one of said top panels, said tongue having a pair of locking ears thereon, said locking ears being offset from said top panel side edges;

a tongue receiving means defined on another top panel, said tongue receiving means including an elongate slot defined in said another panel and having locking ear engaging sections which permit said tongue locking ears to be engaged through said slot and engage said ears to prevent withdrawal of said tongue from said slot, said slot having a longitudinal dimension less than the longitudinal dimension of said tongue so that said tongue will have an interference fit in said slot, and score lines defined in said another top panel extending from said slot for releasing said tongue from said slot by enlarging said slot; and a plurality of trapezoidal bottom panels each having one edge connected to another side edge of each of said side panels and positioned in overlying relationship with each other to form a bottom of the box.

2. An integral box forming blank, comprising:

a first pair of rectangular side panels;

a second pair of rectangular side panels, said side panels having end edges and side edges with said first side panels being connected to each other along a pair of adjacent end edges and each of said second panels being connected along one edge thereof to the other end edge of each of said first panels;

a projecting portion connected to one of said second side panels along the other end edge thereof;

a plurality of rectangular top panels each having side edges and end edges and each connected to a side panel along a side edge and each separated from an adjacent top panel by a cut line;

an elongate tongue connected along another side edge of one of said top panels, said tongue having a pair of locking ears thereon, said locking ears being offset from said top panel side edges;

a tongue receiving means defined on another top panel, said tongue receiving means including an elongate slot defined in said another panel and having locking ear engaging sections which permit said tongue locking ears to be engaged through said slot and engage said ears to prevent withdrawal of said tonge from said slot, said slot having a longitudinal dimension less than the longitudinal dimension of said tongue so that said tongue forms an interference fit in said slot, and score lines defined in said another top panel extending from said slot for releasing said tongue from said slot by enlarging said slot; and a plurality of trapezoidal bottom panels each having one edge connected to another side edge of each of side panels, said bottom panels each having one of the non-parallel sides located adjacent one of the nonparallel sides of an adjacent panel to define a gap between said adjacent panels, and wherein one of said bottom panels having both of the non-parallel sides thereof inclined with respect to the parallel sides thereof.

3. The blank defined in claim 2, wherein the other bottom panels each has one of the non-parallel sides forming a right angle with said parallel sides.

4. The blank defined in claim 2, wherein said projecting portion extends for essentially the entire width of said second side panel other end edge.

* * * * *